United States Patent [19]

Fox

[11] Patent Number: 4,909,054

[45] Date of Patent: Mar. 20, 1990

[54] KEY SHANK WITH RECTANGULAR SLOT AND KEYCASE

[76] Inventor: Robert M. Fox, 15233 Ventura Blvd., Penthouse 10, Sherman Oaks, Calif. 91403

[21] Appl. No.: 752,772

[22] Filed: Jul. 8, 1985

[51] Int. Cl.[4] ..... E05B 19/04; E05B 19/14; A47G 29/10

[52] U.S. Cl. ..... 70/401; 70/408; 70/456 R

[58] Field of Search ..... 70/408, 401, 458, 389, 70/405, 406, 456 R

[56] References Cited

U.S. PATENT DOCUMENTS

| | | | |
|---|---|---|---|
| 588,237 | 8/1897 | Parker | 70/401 |
| 733,203 | 7/1903 | Horgan | 70/408 |
| 1,476,841 | 12/1923 | Raymond | 70/408 |
| 1,693,481 | 11/1928 | Harper | 70/408 |
| 1,939,023 | 12/1933 | Pritchard | 70/458 |
| 2,071,021 | 2/1937 | Brandt | 70/458 |
| 2,734,624 | 2/1956 | Kernicki | 70/456 R |
| 4,037,439 | 7/1977 | Youd | 70/456 R |
| 4,301,664 | 11/1981 | Wilcox | 70/401 X |
| 4,306,433 | 12/1981 | Kelly | 70/456 R |

FOREIGN PATENT DOCUMENTS

| | | | |
|---|---|---|---|
| 77151 | 10/1894 | Fed. Rep. of Germany | 76/110 |
| 319460 | 3/1920 | Fed. Rep. of Germany | 70/408 |
| 360954 | 10/1922 | Fed. Rep. of Germany | 70/408 |
| 574227 | 4/1933 | Fed. Rep. of Germany | 70/401 |
| 329699 | 8/1903 | France | 70/401 |
| 502982 | 12/1954 | Italy | 70/408 |

*Primary Examiner*—Lloyd A. Gall
*Attorney, Agent, or Firm*—Edward A. Sokolski

[57] ABSTRACT

Each key in a set of keys has a headless shank. A slotted opening through the shank is slightly larger than the shank so that any key can be installed over the shank of the active key to act as a wrench to turn the active key. In addition, any shank can carry two blades thereon, one on each end of the shank.

14 Claims, 1 Drawing Sheet

FIG. 1
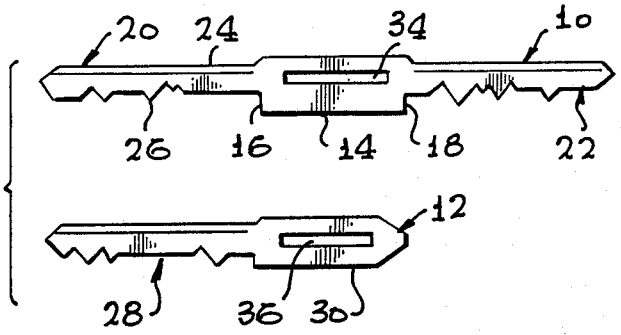
FIG. 2
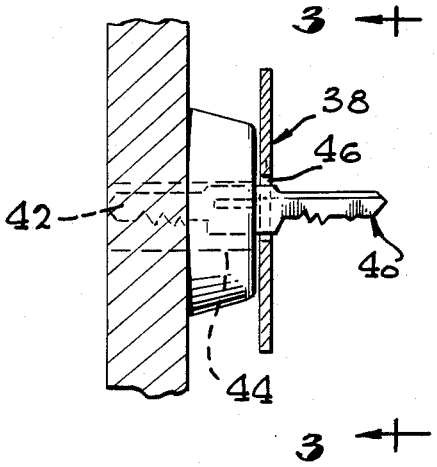
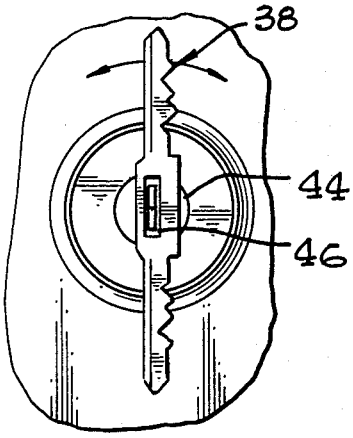
FIG. 3
FIG. 4
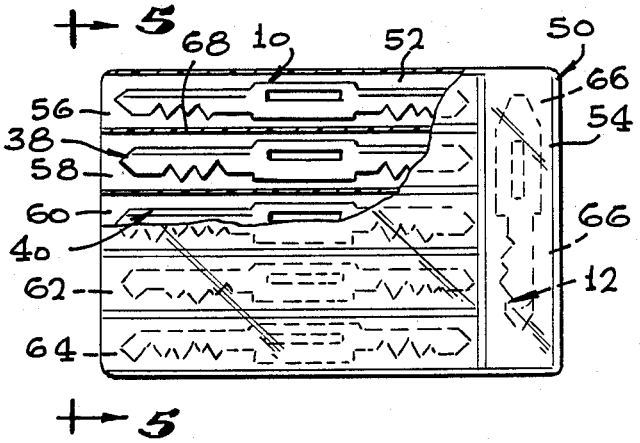
FIG. 5
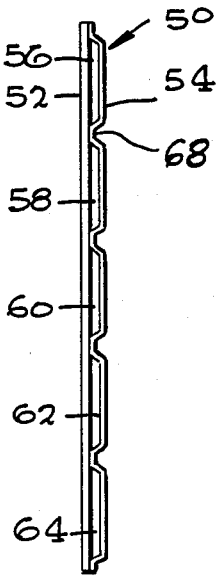
FIG. 6
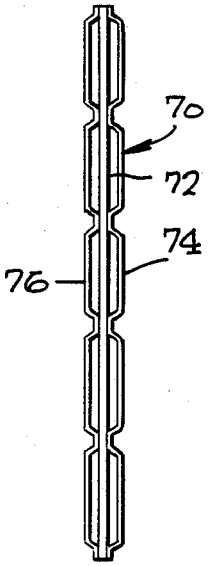
FIG. 7
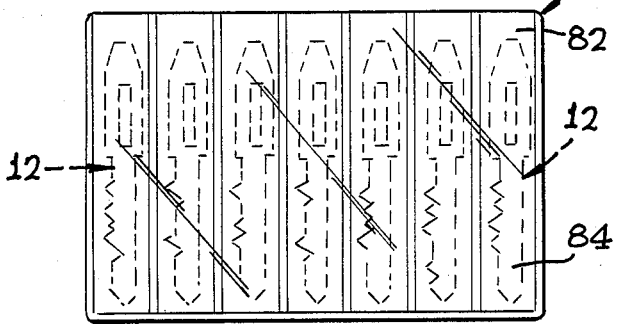

KEY SHANK WITH RECTANGULAR SLOT AND KEYCASE

BACKGROUND OF THE INVENTION

This invention is directed to a set of keys where each is headless, and each carries a slot in its shank so that any key may act as an active key and any other key in the set may act as a wrench for turning the active key.

In modern society, each individual carries a plurality of keys to permit him entry into his secured areas. For example, the individual carries keys to his house, car, garage, office, file cabinets, and other cabinets. The set of keys must be immediately available to the user, or the user finds his access is denied. Should the user lose his keys, access is denied until he obtains a duplicate set. In the ordinary course of events, obtaining a duplicate set is time-consuming so that the user is considerably inconvenienced in having been denied access to those areas which the keys would open. Thus, there is need for compactly and conveniently carrying a duplicate set of keys which may be used until a duplicate set of regular keys can be obtained.

SUMMARY OF THE INVENTION

In order to aid in the understanding of this invention, it can be stated in essentially summary form that it is directed to a headless key which is provided as a set of headless keys. Each headless key has a shank and a blade, with a slot in each shank of such dimensions as to receive the shank of another key. Therefore, any key can be engaged with the active key to serve as a wrench to turn the active key. Any such headless key can have a blade on each end of the shank.

It is, thus, an object and advantage of this invention to provide a set of keys which can be compactly and conveniently carried so that the user may employ them for gaining access to locked areas when his regular set of keys is misplaced.

It is another object and advantage of this invention to provide a set of headless keys wherein each key acts as a wrench to turn any of the other keys so that heads are eliminated and keys are more compact for light and convenient carrying as an extra set of keys.

It is a further object and advantage, of this invention to provide a set of headless keys wherein at least some of the keys have a single shank with a key blade on each end thereof for a further degree in compact carrying, and wherein each of the shanks is slotted so that each key can act as a wrench for turning the active key.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is a side elevational view of a pair of headless keys in accordance with this invention, which interact so that one serves as the wrench for the other.

FIG. 2 is a side-elevational view of such keys in use.

FIG. 3 is an elevational view as seen from the line 3—3 of FIG. 2.

FIG. 4 is a plan view of a carrying case for a plurality of headless keys in accordance with this invention.

FIG. 5 is an enlarged end view, as seen along the line 5—5 of FIG. 4.

FIG. 6 is an end view, on the same scale as FIG. 5, of a second preferred embodiment of a carrying case for the keys in accordance with this invention.

FIG. 7 is a plan view of a third preferred embodiment of a carrying case for carrying the headless keys in accordance with this invention.

DESCRIPTION OF THE PREFERRED EMBODIMENTS

FIG. 1 illustrates headless keys 10 and 12 which are respectively the first and second embodiments of headless keys in the key set of this invention. Headless keys 10 and 12 are of metallic construction; as is usual for keys. Key 10 has a shank 14 of rectangular configuration. The shank is the central portion of the key 10 and terminates at stop shoulders 16 and 18 at each end of the shank. Beyond the stop shoulders, the key 10 has first and second blades 20 and 22. The blades are conventionally as thick as the shank 14, but usually carry detailed longitudinal keyways on the sides thereof to limit the keyholes into which the blades can enter. In many keys, the back 24 is straight, to serve as a reference for the tumbler operating front 26 of the blade. There are usually five or six tumblers in a lock, and the front is configured so that when the key is inserted into the lock with its stop shoulder in place, the configured front 26 moves the tumblers to a position where the tumbler barrel can be turned. In some locks, the back 24 is not straight, but in such locks, a keyway along the length of the blade serves as a reference. All that is required is to turn the key, and the lock is opened.

As has been described, headless key 10 has blades 20 and 22 on opposite ends of shank 14. Headless key 12 is similar, but has only one blade 28 formed on its shank 30. A similar stop shoulder limits the entry of key 12 into its lock.

Slot 34 is provided in shank 14, and slot 36 is provided in shank 30. The shanks 14 and 30 are of the same rectangular dimension, and the slots 34 and 36 are slightly larger than those rectangular dimensions so that the slot in the shank of one key can be slipped over the shank of another key.

In FIGS. 2 and 3, key 40 has its blade 42 entered into the tumbler barrel 44 with the stop shoulder of the key against the corresponding stop in the lock. The blade 42 moves the tumblers to a point where the tumblers are in the unlocked position. In order to apply torque on the key 40, the slot 46 of key 38 is placed over the shank of key 40. Now it is easy to turn the key 40 to cause the unlocking action. Each of the keys 38 and 40 is identical to the key 10, as far as the headless characteristics are concerned. Of course, the configuration of the blades may be different so that the keys open different locks. The key 12 is of the same construction, except that it has only one blade on its shank 30. The appropriate one of a set of such keys is thrust into its lock, and any one of the other keys is used as a wrench. In FIG. 2, a situation is shown where most of the shank enters into the front of the lock so that only enough shank remains extending out of the lock for placement of the key 38 thereover. Thus, the limiting length of the shank is the limiting length of the slot therein. In other locks, most of the shank may extend from the front of the lock, and, under those circumstances, the key acting as a wrench can extend through the slot in the shank of the active key. In this way, very compact headless keys are achieved.

FIGS. 4, 5, 6 and 7 show keycases in which such keys can be compactly carried. Keycase 50 is shown in FIGS. 4 and 5. It comprises backing member 52 which is preferably formed of sheet synthetic polymer composition material. It is of such material and such thickness as to be fairly flexible, but stiff enough to generally maintain its shape and outline. Backing member 52 is of such lateral dimensions as to define the outline of the keycase, and is of substantially the same size as a conventional credit card or the like. Cover 54 is of thinner, preferably transparent synthetic polymer composition material and is configured to form pockets. Between the pockets, the cover is attached to the backing member, as by adhesives or ultrasonic welding. Pockets 56, 58, 60, 62 and 64 are shown as open on the left end of keycase 50, while pocket 66 is shown at the right end of the backing member and is open to the top. Each of the pockets is closed on three edges and open on the other. It is seen that pockets 56, 58 and 60 are dimensioned to receive the double-bladed headless keys 10, the single-bladed headless key 12. One Of the seams between the pocket is shown at 68

Keycase 70, shown in FIG. 6, has the same backing member 72 and cover 74 secured thereon as backing member 52 and cover 54 to define pockets on the front of the backing member. In addition, keycase 70 has cover 76 secured to the back of backing member 72. Cover 76 can be identical to cover 74 or can be a mirror image thereof. The keycase 70 thus provides twice as many slots for keys. The keycase 50 provides space for five double-ended headless keys 10 and space for one single-ended headless key 12, to thus fit eleven different locks. With twice as much pocket space in keycase 70, it can accommodate ten double-ended headless keys 10 and two single-ended headless keys 12 to fit a total of twenty-two different locks.

Keycase 80, illustrated in FIG. 7, is sized to receive seven different single-ended headless keys 12. Keycase 80 has a backing member 82 onto which is secured cover 84 which has pockets formed therein, the same as cover 54. Within the dimensions of a conventional credit card, seven single-ended keys 12 can be pocketed, as shown in FIG. 7. If more space is desired, a back cover can be secured on the back of backing member 82 to double the number of pockets and the keys receivable therein.

From this construction, it can be seen that each headless key has a shank of minimum size, just sufficiently wide to permit the formation of a blade with its tumbler operating configuration, and provide a stop to control the key insertion depth. The shank carries a slot thereon, and the slot is sufficiently long to receive at least the blade of another key, and preferably the shank of another key, as shown in FIGS. 2 and 3. The length of the shank need only be sufficiently long to receive the slot and to permit a portion of the shank to extend from the lock to be grasped. Each headless key is both male in having a blade and a shank, and is female in having a slot in the shank. In the arrangement shown in FIG. 2, the female slot in key 38 engages over the shank of key 40 so that the wrenching key 38 carries the female part. When the key sticks farther out of the lock, the wrenching key can fit into the slot in the active key so that the cooperation between the two keys can be in either of the two arrangements. With a minimum size of the shank, both length and width, compact storage can be achieved.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A key comprising:

an elongated shank of substantially rectangular cross section at right angles to its longitudinal axis, said shank having a thickness and a width at right angles to its thickness, said shank having a stop thereon at one end thereof, a blade secured to said shank and extending beyond said stop, said key consisting of a shank and a blade, a substantially rectangular slot in said shank, said slot having a length slightly greater than the width of said shank and having a width slightly greater than the thickness of said shank, larger sides of said slot being substantially parallel to a longitudinal axis of said shank, thereby to receive the shank of another similar key so that said key can act as a key when said blade thereof is inserted into a lock and another similar key can engage in said slot in said shank so that the similar key acts as a wrench to turn said key.

2. The key of claim 1 wherein said shank has opposite ends and has a blade integrally formed with said shank at each end of said shank.

3. The key of claim 1 wherein said key is a first key in a set of keys and said set further includes a second key substantially identical to said first key, said second key being the similar key, said second key having a slot in it shank substantially identical to said slot in said shank of said first key so that either key may act as a key and the other may act as its wrench.

4. The key of claim 1 wherein said key is a first key and a second key which is substantially similar to said first key, the shank of one of said keys being adapted to fit into the slot of the other of said keys such that the second key acts as the wrench to turn the first key.

5. The key of claim 4 wherein there is a key operating on each end of said shank of said first key.

6. The key of claim 5 wherein said blades on said first key are both integrally formed with said shank.

7. The headless key of claim 6 wherein said second headless key has a blade integrally formed on each end of said shank.

8. First and second keys, each of said first and second keys consisting of a rectangular shank and a blade secured to said rectangular shank, said rectangular shank having a thickness and a width, said blade being configured to enter a lock, said shank being of sufficient length to extend from the lock when said blade is in unlocking position within the lock, a rectangular slot through each said shank, larger sides of each of said slots being substantially parallel to a longitudinal axis of its associated shank, said slot in said first shank being sized to matingly receive said second shank and said slot in said second shank being sized to matingly receive said first shank so that either said first or said second key can be inserted into a lock and the other of said first or second key can engage with a slot in a shank so that said other key can be used as a wrench on said inserted key to turn said inserted key.

9. The keys of claim 8 where on each of said first and second keys, said blade is integrally formed with said shank.

10. The keys of claim 9 wherein at least one of said first and second keys has two blades integrally formed with said shank.

11. The keys of claim 10 wherein both of said keys have two blades integrally formed with its shank.

12. A set of keys comprising:

a plurality of keys, each of said plurality of keys consisting of a rectangular shank having first and second ends and having first and second key blades integrally formed with said shank and extending from said first and second ends thereof, a rectangular slot through said shank of each said key, larger sides of said slot being substantially parallel to a longitudinal axis of said shank, said slot further being sized to receive the shank of another key of said set of keys so that the blade of an appropriate key may be inserted into a lock and another key of said set can interengage with a shank engaged in a slot to turn the appropriate key; and a keycase, said keycase comprising a backing member and a cover together defining pockets in said key case, said cover being secured to said backing member to partially enclose said pockets, at least some of said pockets being sized to receive one of said keys of said set of keys, said pockets being arranged edge-to-edge so that said set of keys can be compactly stored in a substantially flat position.

13. The set of keys of claim 12 wherein said keycase is substantially rectangular and said set of keys is positioned substantially longitudinally of said keycase.

14. The set of keys of claim 13 wherein said keycase further includes a transverse pocket and there is a further key in said transverse pocket, said further key having a slotted shank and a single blade secured to said shank.

* * * * *